US006958018B1

(12) United States Patent
Florian

(10) Patent No.: US 6,958,018 B1
(45) Date of Patent: Oct. 25, 2005

(54) FOLDING GOLF SWING PRACTICE MAT

(76) Inventor: Raymond J. Florian, 14440 Elwell, Belleville, MI (US) 48111

( * ) Notice: Subject to any disclaimer, the term of this patent is extended or adjusted under 35 U.S.C. 154(b) by 0 days.

(21) Appl. No.: 10/931,721

(22) Filed: Sep. 2, 2004

(51) Int. Cl.[7] ..... A63B 69/36
(52) U.S. Cl. ..... 473/278; 473/218; 473/257
(58) Field of Search ..... 473/150, 157, 473/168, 218, 266, 278, 276, 257

(56) References Cited

U.S. PATENT DOCUMENTS 4,130,283 A * 12/1978 Lindquist ..... 473/262
4,311,312 A * 1/1982 O'Brien ..... 473/218
4,387,896 A * 6/1983 O'Brien ..... 473/218
4,928,966 A * 5/1990 Miller ..... 473/262
4,932,663 A * 6/1990 Makar ..... 473/262
5,356,147 A * 10/1994 MacDonald ..... 473/278
5,590,882 A * 1/1997 Todd ..... 473/218
5,645,494 A * 7/1997 Dionne et al. ..... 473/278
5,888,147 A * 3/1999 Luedtke ..... 473/278
5,954,592 A * 9/1999 Laffer et al. ..... 473/220
6,156,396 A 12/2000 Florian
6,468,167 B1 10/2002 Florian

* cited by examiner

*Primary Examiner*—Nini F. Legesse
(74) *Attorney, Agent, or Firm*—Charles W. Chandler

(57) ABSTRACT

A golf club practice swing mat for improving a golfer's backstroke and power stroke includes a grass mat on which a practice ball is mounted. An anchoring mat is mounted on the same ground surface as the grass mat and fixed with respect to the ground surface. An elastic band connects the grass mat to the anchoring mat in such a manner that when a user engages the grass mat with a golf club, the grass mat moves in the direction of the golf club swing, and then returns to its initial position. The two mats are folded together for transport.

6 Claims, 3 Drawing Sheets

FOLDING GOLF SWING PRACTICE MAT

BACKGROUND AND SUMMARY OF THE INVENTION

This invention is related to an improved, portable golf swing practice mat, and more particular to a folding mat that is both easy to carry and to set-up for use.

In my U.S. Pat. No. 6,468,167 issued Oct. 22, 2002, for a "Golf Practice Mat", I disclosed an improved golf swing mat. A user, having a laser light mounted on the handle of his club, improves his golf club swing by swinging the club such that the light follows a guideline on the mat. The mat is a one piece component.

In my U.S. Pat. No. 6,156,396 issued Dec. 5, 2000, for a "Golf Practice Mat", I disclosed a mat having a base pad that is disposed on the ground. An artificial grass pad is mounted on the base pad. The upper surface of the base pad has a covering of an anti-friction or slippery material. The grass pad is mounted on the base pad to slide in the direction of the golfer's swing, in response to the imprint of the golf club striking the practice ball and the mat.

My prior mats are useful for practice, however, they are difficult to carry because of their weight and overall size.

The broad purpose of the present invention is to provide a golf practice mat (pad) in which a practice ball is mounted on an artificial grass pad. The pad has a bottom surface with a low friction characteristic so that it can be placed directly on a supporting hard surface, such as a gym floor or concrete. The grass pad is so thick it does not need the foam layer of my prior mats. This upgraded grass pad easily absorbs the hard concussion of a golf club. Thus, upon impact by a golf club, the whole mat slides forward like a divot, but snaps right back for the next shot.

An anchoring second pad is mounted at the rear end of the grass pad. The anchoring pad is held in a fixed position by any suitable means, such as a double functional brick, to remain stationary during the course of a practice swing. A resilient band connects the grass pad to the anchoring pad in such a manner that when the golfer strikes the grass pad during the course of a swing, the grass pad advances in the direction of the ball motion and then returns to its initial position.

My improved practice mat provides several advantages over my prior mats. For example, the two pads can be folded face-to-face for carrying. The two pads weigh much less than my prior practice mats. The grass pad can slide under the impact of a golf club without requiring a base pad under the grass pad. The grass pad also has improved guidelines marked on its upper surface to guide the golfer's swing by using a laser light in the handle of the golf club and the desired placement of the golfer's feet.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
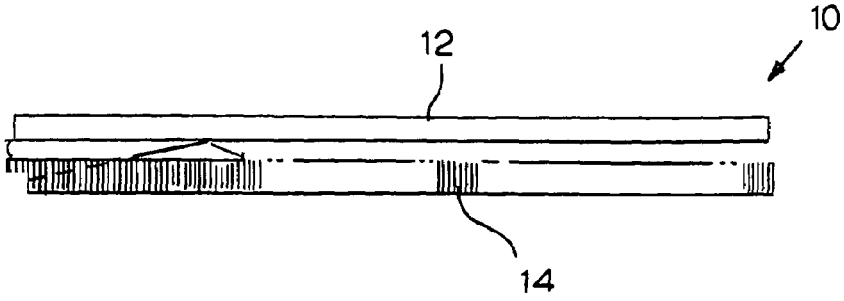
FIG. 1 illustrates a preferred practice mat in its folded position.

Referring to the drawings, FIG. 1 illustrates a golf practice mat 10 comprising an anchoring mat 12 disposed in a face-to-face relationship with respect to a grass mat 14. A brick 16 holds the anchoring mat in a fixed position with respect to a supporting surface 18, such as a gym floor. The anchoring mat has a thickness of about ½" and comprises a rubber coated material applied on a stiff board, about 6" in width and 18" in length. This arrangement permits the user to mount the practice mat on a surface without using stakes or other objects that penetrate the ground. However, when mounted on grass, a stake (not shown) may be inserted in the ground in place of an anchoring mat.

Grass mat 14 has a forward end 20 and a trailing end 22. Mat 14 is rectangular in configuration, and for illustrative purposes is about 12" wide and 18" long.

Figure 3:
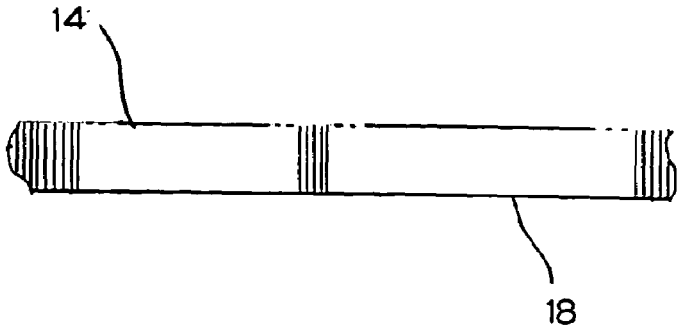
FIG. 3 is a fragmentary cross-sectional view through the grass mat.

Referring to FIG. 3, the grass mat material is used as artificial turf for various sporting activities, such as football or baseball. The grass mat material is available from Grass Tex, Inc. of Dalton, Ga. under the name HI-Tech Turf. The lower surface of mat 14 will slide on supporting surface 18.

Figure 2:
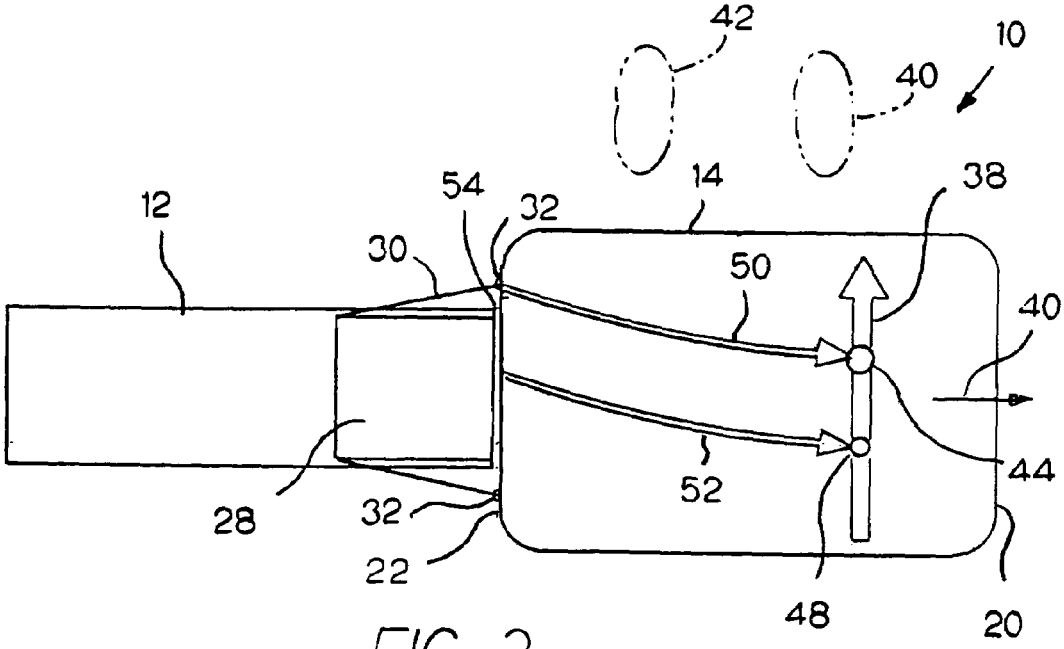
FIG. 2 is a plan view of the practice mat.
Figure 4:
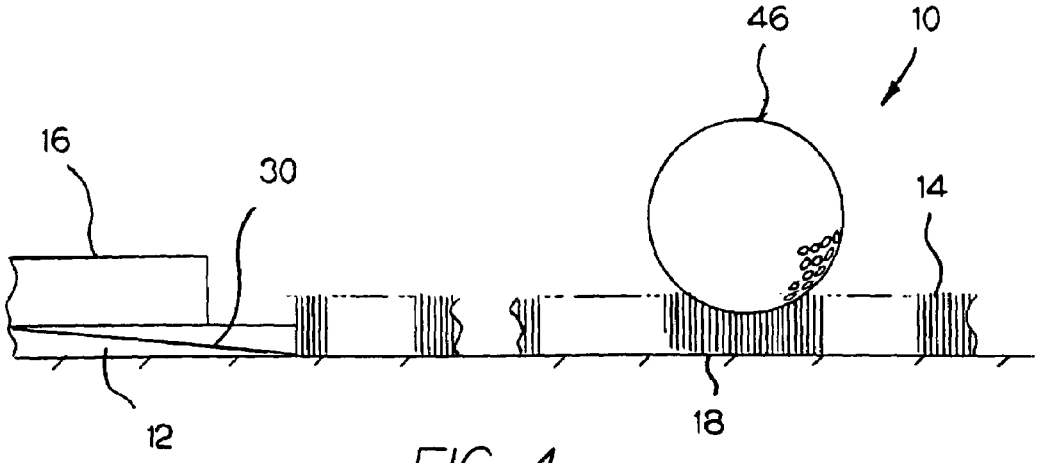
FIG. 4 is an elevational sectional view illustrating the grass mat and the anchoring mat in their initial positions.
Figure 5:
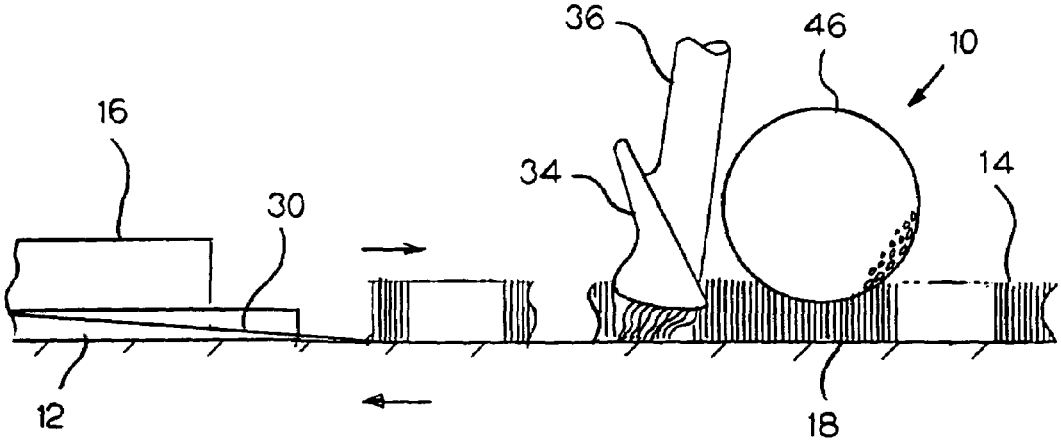
FIG. 5 shows the grass mat being separated from the anchoring mat, in response to a swinging golf club.

Referring to FIG. 2, a stiff panel 28 is attached to the upper surface of the anchoring mat. A resilient band 30 has its ends attached in spaced positions by any suitable means, such as rivets 32, to the grass mat. The midsection of resilient band 30 is wrapped around panel 28. The arrangement is such that when the grass mat is in an initial position abutting the anchoring mat, as illustrated in FIG. 4, the impact of head 34 of a golf club 36 on the grass mat will drive it in the direction of the club head, away from the stationery anchoring mat, as illustrated in FIG. 5. At the end of its forward motion, the grass mat will then return to its initial position shown in FIG. 4, abutting the anchoring mat.

Referring to FIG. 2, the grass mat has a linear guideline 38 applied to the mat surface in a direction perpendicular to the intended motion of the ball in the direction of arrow 40. The purpose of guideline 38 is to assist the golfer in positioning his feet 40 and 42 adjacent the mat. The location of his feet depends in large part upon the type of club he is using.

A rubber-like resilient tubular tee 44 is mounted on guideline 38 for supporting a ball 46 in a raised position. Tee 44 is used when the ball is to be elevated for practice with a wood club. Ball locating circle 48 is applied directly on the mat and used when the ball is to be mounted directly on the simulated grass.

A pair of curved guidelines 50 and 52 are applied on the grass mat from the trailing end 22 toward tee 44 and toward ball locating circle 48, depending upon which club is being used.

Figure 6:
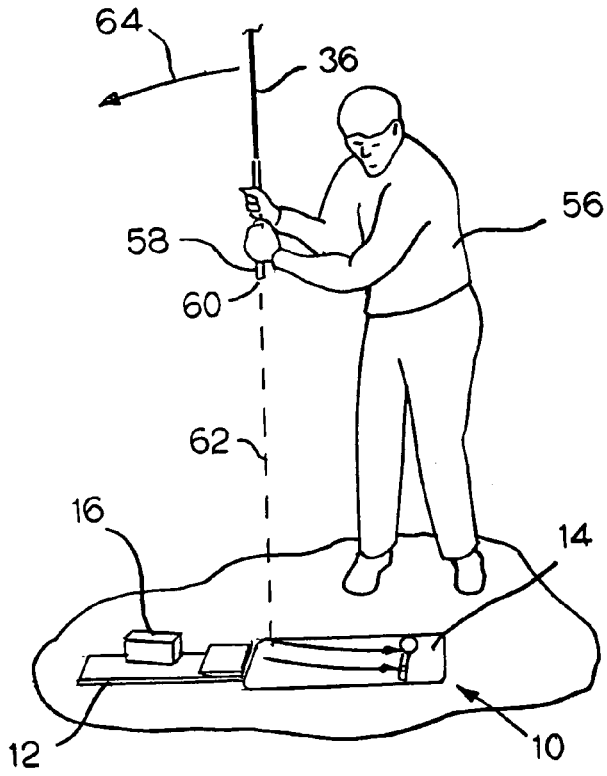
FIG. 6 is a view of a golfer initiating a swing toward a preferred practice mat.

A backswing indicator or flipper 54 is mounted along the backswing path of the golf club, as illustrated in FIG. 6, and described in detail in my U.S. Pat. No. 6,468,167. The flipper has a relatively stiff flat head attached by a hinge to a base. Initially the flipper head is disposed in an upright position. As the user swings his club rearwardly an appropriate distance above the ground, the club head will strike the flipper head causing it to pivot to a horizontal position. If the club misses the flipper, the user then makes an appropriate adjustment in his backswing.

FIG. 6 illustrates a golfer 56 having his feet mounted adjacent the practice pad and holding club 36. The club handle 58 has a battery-powered laser light 60. The laser light is inserted in an opening in the handle and emits a very focused beam 62. The laser light is mounted so that the beam forms an extension of the shaft axis. The user commences his backswing by raising the club head and shaft as illustrated in FIG. 6. The user then commences his forward power stroke in the direction of arrow 64 with the club handle moving so that the laser light directs beam 62 on the grass mat surface aligned with either guideline 50 or guideline 52, depending upon the club being used. If the user employs a proper swing, the laser light will follow a guideline which is aligned with the position of the practice ball. If he misses the practice ball, he then makes an appropriate adjustment such as with the placement of his hands or his feet, to correct his swing.

Figure 7:
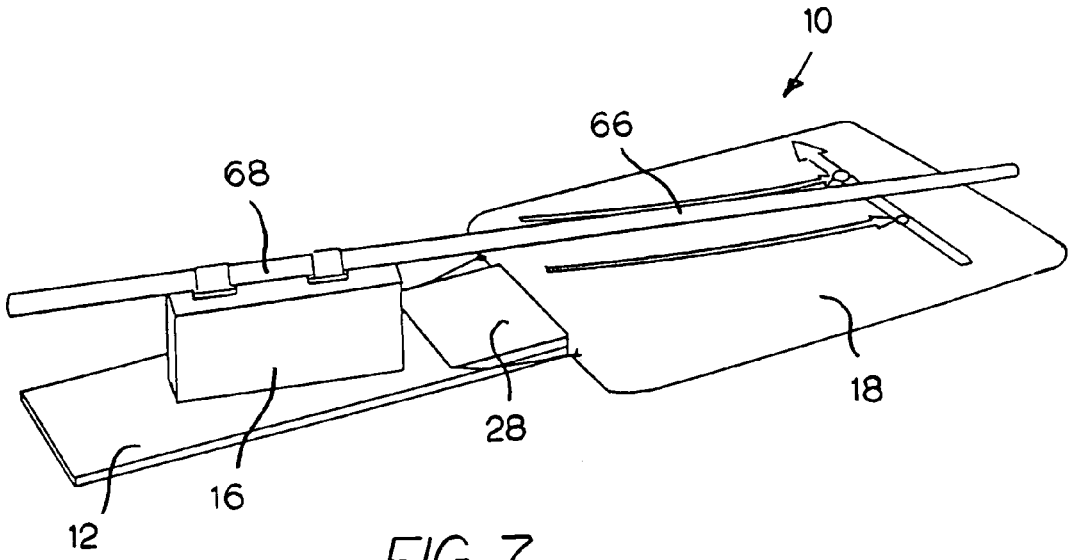
FIG. 7 illustrates the preferred mat with a guide tube mounted on the anchoring brick.

FIG. 7 illustrates a guide tube 66 having one end 68 connected to the brick and its other end suspended above the grass mat, adjacent the desired guideline 50 or 52. The club head will miss the guide tube, if the club is swung in a proper swing.

What is claimed is:

1. A golf club swing practice mat, comprising:

a non-cushioned ball-supporting mat having an artificial grass layer on an upper surface, a planar, slidable lower surface, a leading end and a trailing end;

a golf ball-supporting structure mounted on the upper surface of the ball-supporting mat between said leading end and said trailing end;

a planar anchoring mat disposed in a parallel, face-to-face position with respect to the ball-supporting mat, the anchoring mat having an upper surface;

the anchoring mat being movable away from said face-to-face position to a coplanar position with respect to the ball-supporting mat;

a body disposed entirely on the upper surface of the anchoring mat, said body having a weight sufficient to maintain the anchoring mat in a fixed position with respect to a supporting surface as the upper surface of the ball-supporting mat is struck by a golf club;

resilient means for connecting the ball-supporting mat to the anchoring mat when the ball-supporting mat and the anchoring mat are in a coplanar first position, in which the trailing end of the ball-supporting mat abuts the anchoring mat, and a second position in which the trailing end of the ball-supporting mat is spaced from the anchoring mat when the upper surface of the ball-supporting mat is struck by a golf club moving toward the leading end of the ball-supporting mat; and said resilient means comprising an elastic band, and first means for connecting the elastic band to the anchoring mat in a position above the plane of the lower surface thereof, and second means for connecting the elastic band to the ball-supporting mat in a position above the plane of the lower surface of the ball-supporting mat the resilient means being operative to bias the ball-supporting mat from said second position toward said first position.

2. The golf club swing practice mat of claim 1, including a guideline means disposed on the upper surface of the ball-supporting mat for guiding a golfer's club in a swinging movement.

3. The golf club swing mat of claim 2, in which the guide line means is operative to guide a golfer's club in a swinging motion toward either a position in which a practice golf ball is placed directly on said artificial grass layer, or in a raised position with respect to said grass layer.

4. The golf club swing mat of claim 1, including a back-swing indicator mounted on the anchoring mat so as to be moveable from an upright position toward a lower position when the indicator is struck by a club head during a back swing motion to indicate to a golfer whether or not the club head is being moved at a proper height above the ball-supporting mat.

5. The golf club swing mat as defined in claim 4, in which the back-swing indicator comprises a flipper member mounted adjacent the ball-supporting mat so as to be moveable between an upright position and a lower position, and means pivotally connecting the flipper member to the anchoring mat in a position to be struck by a golf club being swung in a backstroke, from said upright position to said lower position.

6. The golf club swing mat as defined in claim 1, including a golf club having a head and a handle, and visual alignment means carried on the golf club handle for indicating the position of the club head with respect to said ball-supporting mat.

* * * * *